US006256553B1

(12) United States Patent
Erikkilä

(10) Patent No.: US 6,256,553 B1
(45) Date of Patent: Jul. 3, 2001

(54) METHOD AND DEVICE TO PICK UP, TRANSPORT AND PUT DOWN A LOAD

(75) Inventor: Jouni Erikkilä, Espoo (FI)

(73) Assignee: Sime Oy, Espoo (FI)

( * ) Notice: Subject to any disclaimer, the term of this patent is extended or adjusted under 35 U.S.C. 154(b) by 0 days.

(21) Appl. No.: 09/068,267

(22) PCT Filed: Nov. 13, 1996

(86) PCT No.: PCT/FI96/00615

§ 371 Date: May 5, 1998

§ 102(e) Date: May 5, 1998

(87) PCT Pub. No.: WO97/18153

PCT Pub. Date: May 22, 1997

(30) Foreign Application Priority Data

Nov. 14, 1995 (FI) ..... 955485
Dec. 19, 1995 (FI) ..... 956110

(51) Int. Cl.[7] ..... G06F 7/00
(52) U.S. Cl. ..... 700/213; 212/284
(58) Field of Search ..... 700/213; 212/284, 212/270

(56) References Cited

U.S. PATENT DOCUMENTS 3,826,380 7/1974 Lenander et al. .
4,281,342 * 7/1981 Useda et al. ..... 358/93
5,152,408 10/1992 Tax et al. .
5,491,549 2/1996 Wichner et al. .
5,729,453 * 3/1998 Lee et al. ..... 364/424.07
5,760,415 * 6/1998 Hauck et al. ..... 250/559.33
6,055,619 * 5/2000 Miyata et al. ..... 212/286

FOREIGN PATENT DOCUMENTS 44 23 797 1/1996 (DE) .
596330 5/1994 (EP) .
668236 8/1995 (EP) .
677478 10/1995 (EP) .
2221212 1/1990 (GB) .
502609 11/1995 (SE) .

OTHER PUBLICATIONS

Enghish Language Translation of Patent Abstracts of Japan, Publication No. JP5077175, dated Mar. 30, 1993.
English Language Translation of Patent of Patent Abstracts of Japan, Publication No. JP6024680, dated Feb. 1, 1994.
Patent Abstracts of Japan, Publication No. 07309582, dated Nov. 28, 1995.

* cited by examiner

*Primary Examiner*—Christopher P. Ellis
*Assistant Examiner*—Khoi H. Tran
(74) *Attorney, Agent, or Firm*—Andrus, Sceales, Starke & Sawall, LLP

(57) ABSTRACT

A crane control based on quoted location data and observed ambient data provided by at least one identifier, the goods to be conveyed by the crane can be controlled to the location site. The identifier takes pictures of at least two difference areas, which is implemented so that the identifier is pivotable, or fixed, whereby the certain image area directed to the identifier is reflected from a reflecting surface.

16 Claims, 14 Drawing Sheets

υGROUND = υTROLLEY ± υGRIPPER

FIG. 13A
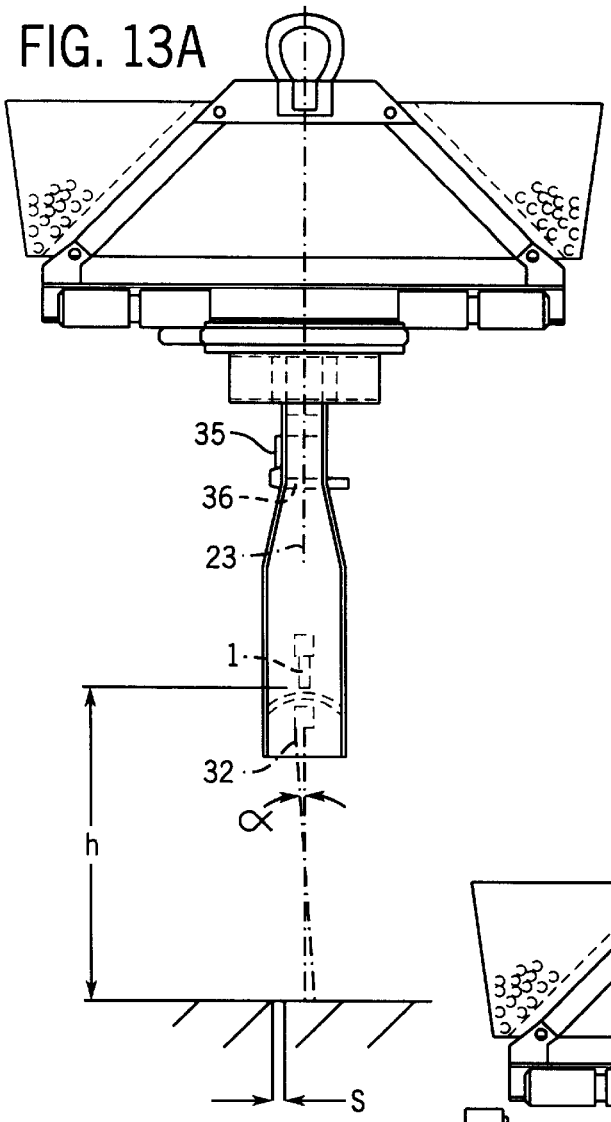
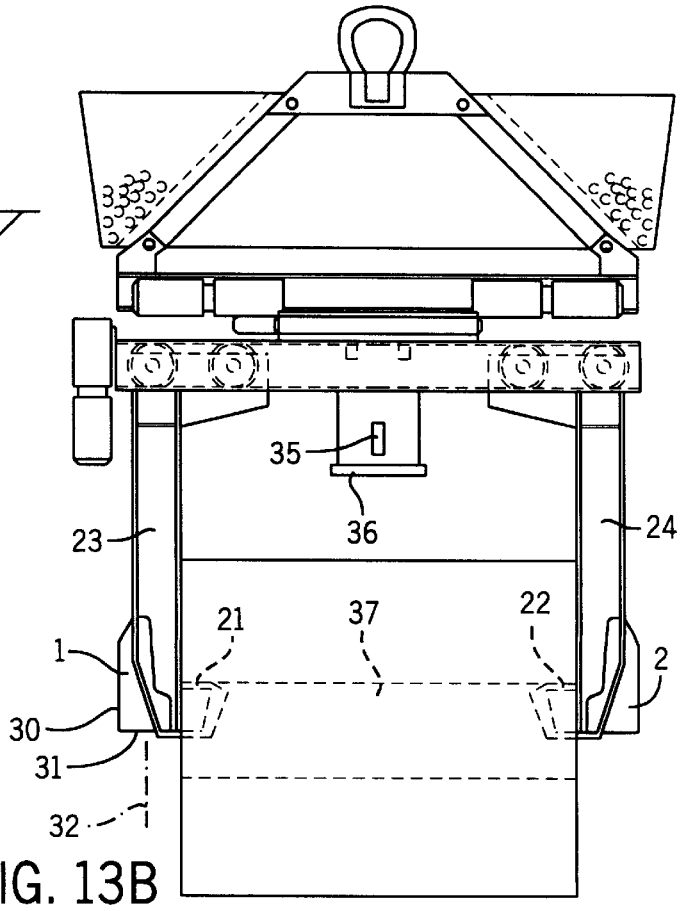
FIG. 13B

METHOD AND DEVICE TO PICK UP, TRANSPORT AND PUT DOWN A LOAD

BACKGROUND OF THE INVENTION

The objective of the invention is a method for conveying a load between location sites, preferably sub-methods for gripping the load, placing the load on a desired site and for controlling the crane based on information received from the identification means, as well as an equipment therefor.

A crane is used to lift and move rolls, containers or corresponding products from one place to another with at least one grip member, e.g. a C-hook, or with two grip members placed on the opposite sides of the load to be gripped, or with several grip members. Bridge cranes, hosting cranes, is knuckle boom cranes can be moved fairly precisely on rails, but several factors, such as wind, stretching of the crane cable, swings, bending of the crane construction caused by the weight of the load to be lifted, cause trouble in gripping the load and moving it to a desired site. Piling of the load causes trouble when the first goods are placed at the bottom of the load, or when stacking the outer portions of the pile, when there is not corresponding goods on the other side of the goods to be stacked but an edge, e.g. the edge of a ship hold or a floor (empty). This has been a problem due to the lack of a suitable observation means for this purpose to survey the desired site to obtain an image of the correct angle. All machines, ships, trains, trucks and movable goods can temporarily be positioned in relation to each other either by measuring electrically or also physically by a metering device. A known satellite positioning is the GSP-method (Global Positioning System), in which the positioning of the gripper or the machine part in relation to the positioning satellites is implemented with an accuracy of 0.1–1 meter. The GSP-positioning functions so far only outdoors. This is not always functional or sufficiently accurate.

When loads are being conveyed on crane cables, the load comes into a swinging movement, which makes the work difficult. The swings have been taken into consideration by using e.g. a synchronizer, whereby each produced change of acceleration is followed by another equally big change but in the opposite direction after a certain time period. To damp the swing, an optimal speed profile is calculated for the motion, which eliminates the swing at the end of the motion and minimizes the time used for the motion. Previously known solutions have thus defined the swing equation of the load based on calculated values. The swing of the load can be controlled by the information. The swing control is in fact based on the calculated default formula. No real time control is arranged. When current systems use different counterforces to absorb the load swing, the target site might drift elsewhere than to a certain site, and a repetition of the same stop event at the same known target site seems fairly theoretical.

The swing absorption of the load should also function with a gantry robot lifting pillar or other structure preventing the free swinging of the load and the gripper. The robot lifting pillar is assumed to be rigid with a small load. When the bulk to be transferred is increased, bending is conducted also on the pillar by the load carrying structures, but these do not follow the mathematical harmonic swing formula, because the load carrying structures of the load act as springs. The arranging of the swing absorption by some mathematical formula would thus require empirical tests, as the spring constants etc. of the structures vary in e.g. a bridge construction according to how close the trolley is from the end carriers of the bridge. The above presented situations can also be managed by the invention.

The problem can e.g. be that when the crane driver obtains information about the transit distance of the cable, this does not generally enable him to drive the load sufficiently accurate to the desired site, as e.g. the 10 ton and 30 ton load carried by the crane causes a bending of a different size on the crane bridge and also on the stretching of the cable. Changes in the loading platform of the goods (ship's draft) can also cause problems to the crane driver. One solution to the above mentioned problems has been to e.g. identify lines marked in the ground or alike by a recognition means provided in the crane, based on which the load is transferred and the location becomes known. This is characteristic for container travelling gantry cranes. The markings cause additional work and the maintenance can be difficult.

SUMMARY OF THE INVENTION

An improvement is achieved by the invention to the above mentioned matters. The invention is substantially characterized in what is presented in the following specification regarding a method for conveying a load between location sites, preferably regarding sub-methods for gripping the load, placing the load on a desired site and for controlling the crane based on information received from the recognition means, as well as regarding an equipment therefor.

A technical solution is presented both for the gripping situation of the goods and for the transferring of the goods in the gripper to a pre-known mathematical environment. All previously known solutions have aimed at increasing the loading effectiveness with fixed recognition means, sensors, cameras, which has required the use of different auxiliaries, as presented above. The invention avoids marking of lines. The view angle of the camera used can further be selected and freely adjusted. Only the certain area of the picture can be viewed. The advantage of the invention is also that the crane driver can be given the necessary control data so that the crane driver can concentrate on driving. The load swing is according to the invention controlled almost in real time. Calculation of different swing equations or the like is avoided. The invention aims in fact essentially at real time observation, i.a. the location of the load in relation to the target area or a possible obstacle is known. One feature of the invention is also that it improves the possibilities of preventing transport damage of the goods.

BRIEF DESCRIPTION OF THE SEVERAL VIEWS OF THE DRAWINGS

The invention is below described with reference to the specification and the figures, wherein

FIGS. 13A and 13B are orthogonal views showing the measuring of the distance between the gripper and the object by laser beam.

DETAILED DESCRIPTION OF THE INVENTION

Figure 1A:
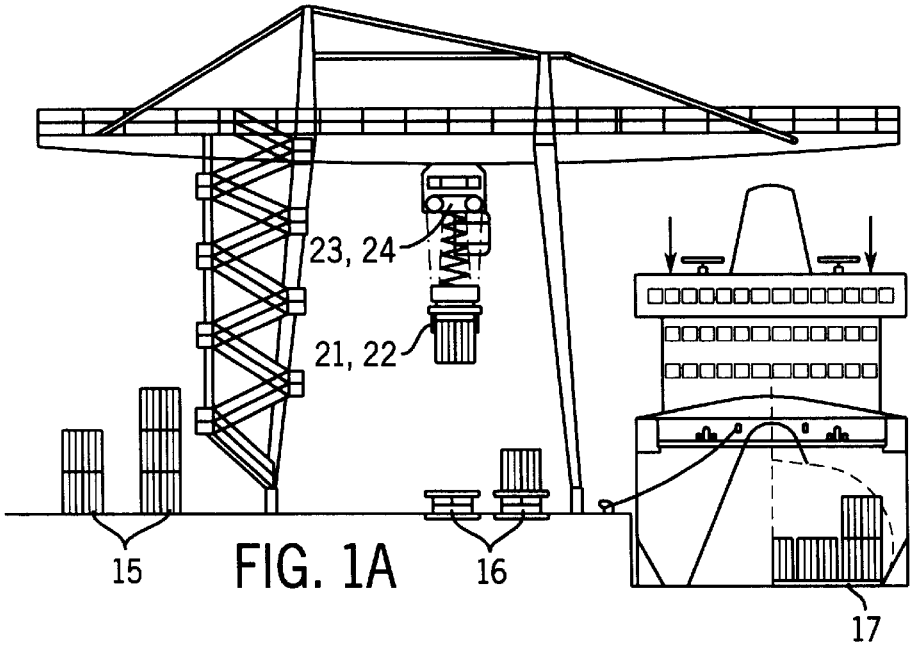
FIGS. 1A and 1B show a basic picture of the conveying system.
Figure 1B:
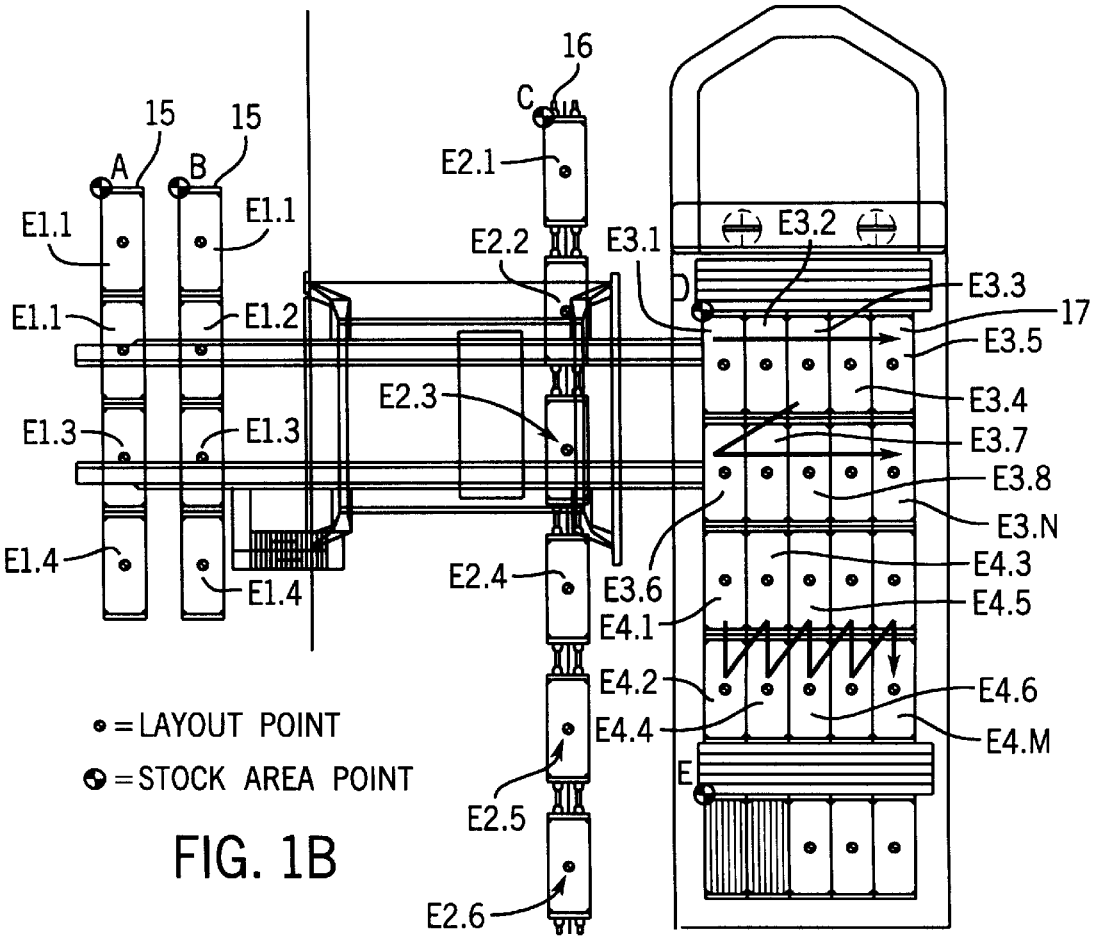

FIG. 1A and 1B present a common lift arrangement between two or several stacks of goods in a harbor container crane operation area from two directions. In an automatic or semi-automatic transferring operation the lifting of the goods is implemented based on the typesetting figures recorded in the computer or logic memory. The typesetting figure comprises the summing data of the reference points and the deviation files, which form the point space of the crane, defining the theoretical (pre-calculated) location place of the product in the stack 15, goods van 16 and ship 17. The theoretical location site is specified based on the real picture given by the camera from where the information is transmitted to the crane control system in order to find the right location site of the product. The points A, B, C, D and E depict the reference points of each pile to which the deviation is summed to provide information about the individual position of each product in relation to the reference point of the stack. In FIG. 1 E n,n or m,n,m=integer contains the theoretical data of the desired location place of each desired product, such as the container, reel, in relation to the reference point. Based on this data and the data provided by the camera the grippers are controlled to place the product in the location place defined by data obtained in advance. Due to stretching of the cable, wind, etc. the location place has to be changed based on image data obtained from the camera. The crane is movable on a rail and/or by different carrier, jib, etc. solutions. The crane can be provided with several shafts operating simultaneously. The crane can be manually operated, semi-automatic or automatic.

For example, although the selected point would have been changed, e.g. the previous truck is loaded and a new truck has been driven close to the truck loading place, to the place '1999'-point, the gripper starts loading the truck from the beginning, from the first record of the deviation file. The vertical intersection point of the truck front loading platform has been programmed into this deviation point as the entry system check point. Even if the position of the truck should be slightly different from the previous one, the gripper searches the loading platform front angle based on the camera picture data, and takes the first container on the platform. The next container, in the deviation point 2, focuses the camera on the vertical intersection point of the first container observing simultaneously the height change that occurred in the height of the pattern recognition (about one container upwards). Besides the management and control of the camera system based on data saved in the memory, the position and deceleration points of the new product to be transferred are compared to the previous product or products, which determine when the crane is to be operated slower, i.e. when approaching the location site of the load.

The gripper can be operated normally during the transfer when there is no sharp line, curve, etc. in the field of view but the picture is blurred. When a sharp uniform interface appears in the picture, the gripper motion is automatically stopped. When the deviation record has been given a fixed, active area resulting from the physical position of the machine vision system, the malfunctions caused by the product in the gripper or other construction features of the crane are eliminated.

Figure 2A:
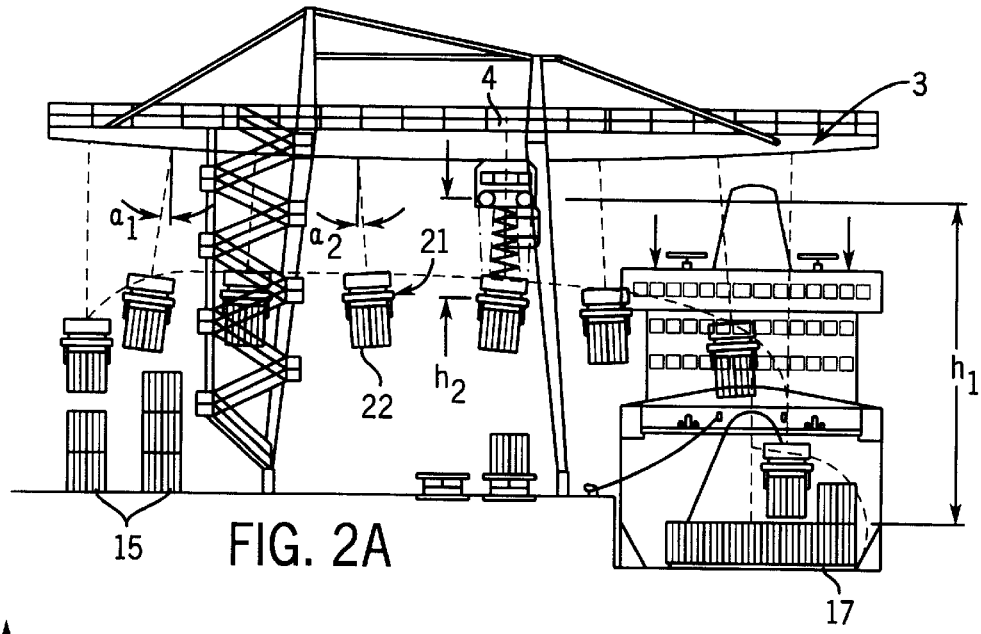
FIGS. 2A through 2D illustrate as a basic picture the transferring of the load from one site to another and related physical phenomena.

The bridge crane presented in FIG. 2A comprises a bridge 3 and a horizontally moving trolley 4 thereon. The trolley 4 is moved in the direction of the horizontal movement of the trolley, which causes swinging. The driving gear of the trolley comprises an electric motor, an electric current controlled brake and a suitable transmission gear, which are not shown. The trolley comprises a hoisting gear controlling the cable motion. If reviewing a normal hand-operated container crane's transferring of one container from pile 15 to the ship's hold 17, the driver has to carry out several correction and pre-maneuver commands. Between the start command of the trolley and the actual starting of the movement of the trolley is a time delay of 20–500 ms depending on the construction and quality of the control system. When the driver changes the control command, the trolley always follows after a time delay. After the attachment the hoisting and the horizontal transfer towards the target point starts. Because the gripper 21, 22 during the transfer does not only swing according to the mathematical pendulum but also due to wind power, bending and/or stretching of the crane constructions, etc. additional forces, the camera provides a new opportunity especially when approaching the target area with the gripper 21, 22 and the product. The machine vision system due to the deviations and stock points has more known information about the target area compared to a completely unknown target surrounding.

Figure 2B:
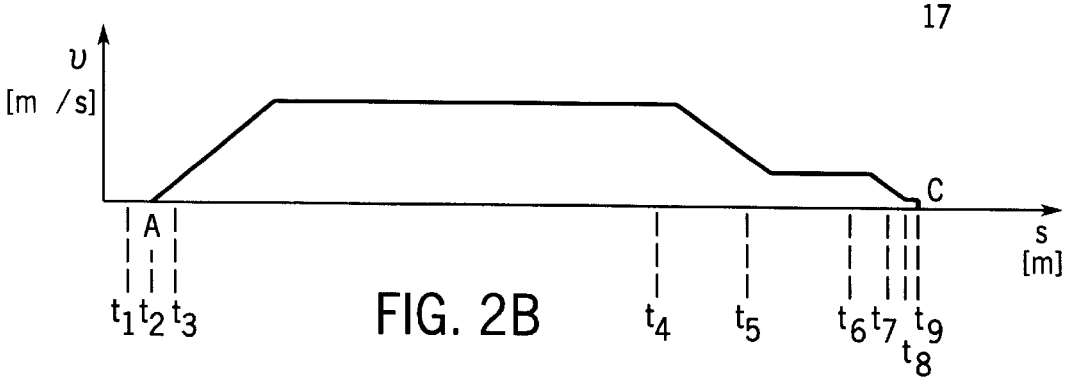
Figure 2C:
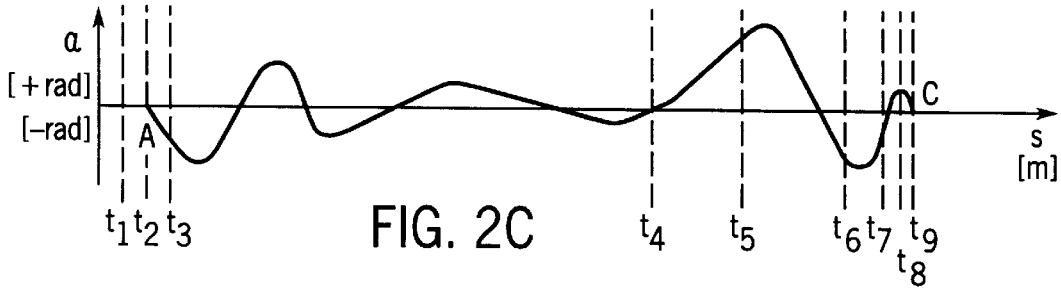
Figure 2D:
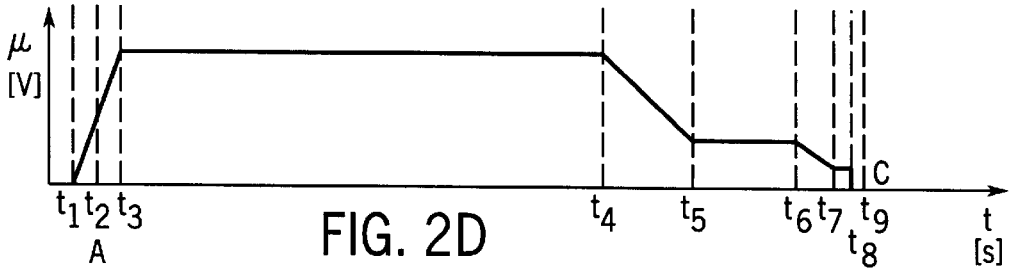

When the crane trolley arrives at the programmed target point the objective is to create a situation where the swing of the grippers 21, 22 would have been damped before the trolley stops. The target area is then approached first utilizing the camera to damp the swing of the load, and especially in the last step to position the load in the actual target area, when from a certain front angle of the already positioned load, e.g. a container, the location site of the load to be transferred is recognized by a turning camera 1, 2. FIGS. 2B through 2D contain diagrams, of which the upper one, FIG. 2B, illustrates the driving speed as a function of the conveyed distance. The middle diagram, FIG. 2C, illustrates the swinging of the gripper 21, 22 without damping of the swing. The optimal driving instruction of the automation system should be anticipated when driving the gripper 21, 22 to the target point, as presented in the lowest diagram, FIG. 2D. The changes of the gripper's 21, 22 (spreader) swing angle are presented in FIG. 2 also as load motions. The piles between which the transfer is made are marked by letters A, B and C. Different reference times relating to the motion step are presented by $t_1$–$t_9$.

The damp of the swing of the load when the distance, i.e. height information $h=h_1-h_2$, between the camera and the target is not known, can be performed during the horizontal motion at the interval $t_1 \ldots t_7$ by turning the camera 1, 2 of the gripper 21, 22 upwards and by reviewing the crane main supports (or main support), the bridge or bottom surface of the trolley by an illuminated laser light recognition technique or the like technique by placing the known shape above the gripper 21, 22 in the known place. The actual transfer of the product to the target area would take place at the interval t. . . $t_9$. Although the above mentioned times overlap, the starting point of the approaching can be chosen freely if the system comprises several cameras. Four cameras can be connected to the same control computer in present camera systems. One of these could then be directed upwards and two other would be in the gripper 21, 22 jaws. Another alternative e.g., however not equally good, is that the cameras are placed in the grippers, and one camera is additionally provided in the trolley to observe the gripper and the load swing. When the floor level or the upper surface level of the goods on the floor and the features of the gripper are known, the accurate motion of the gripper in relation to the floor can be determined. This application has the numeric positioned height of the gripper from the crane.

It is not necessarily essential that the damp of the load swing would actually be implemented from the area below the gripper 21, 22, but that the load swing damp has been considered in general.

Below is presented alternatives for determining the height of the crane gripper 21, 22 from the desired platform, i.e. the distance between the target area and the gripper. In the absence of the crane gripper 21, 22 height information, the selected target area to be reviewed can be determined from a video picture using a combination of the camera/cameras 1, 2 and the laser beam 32 according to FIGS. 13A and 13B. The relative transition of the selected target area is calculated and converted to the crane control data based on two successive or very close video picture samples of the machine vision camera (RGB, CCD-camera) image area. The laser beam 32 from the semiconductor laser source provided in the gripper, is set in the known angle $\alpha$ in relation to the center axis of the cameras. As the laser beam does not disperse in the same way as a normal light beam, the shape of the light reflected from the laser beam reflection point to the camera 1, 2 is constant and easy to retrieve reliably even from a big picture material. The distance of the gripper 21, 22 from the target, measure h, can be calculated in FIGS. 13A and 13B, when the laser light reflection is found by the computer 5 from the picture material provided by the camera. Depending on the deviation s from the selected point of the camera image area, the distance of the light point from the gripper can be exactly calculated, as the angle a is known. The camera in use provided with a zoom objective is calibrated when the system is taken into use, whereafter the height of the gripper from the object can always be calculated when the magnification ratio of the zoom objective has been considered.

Figure 3:
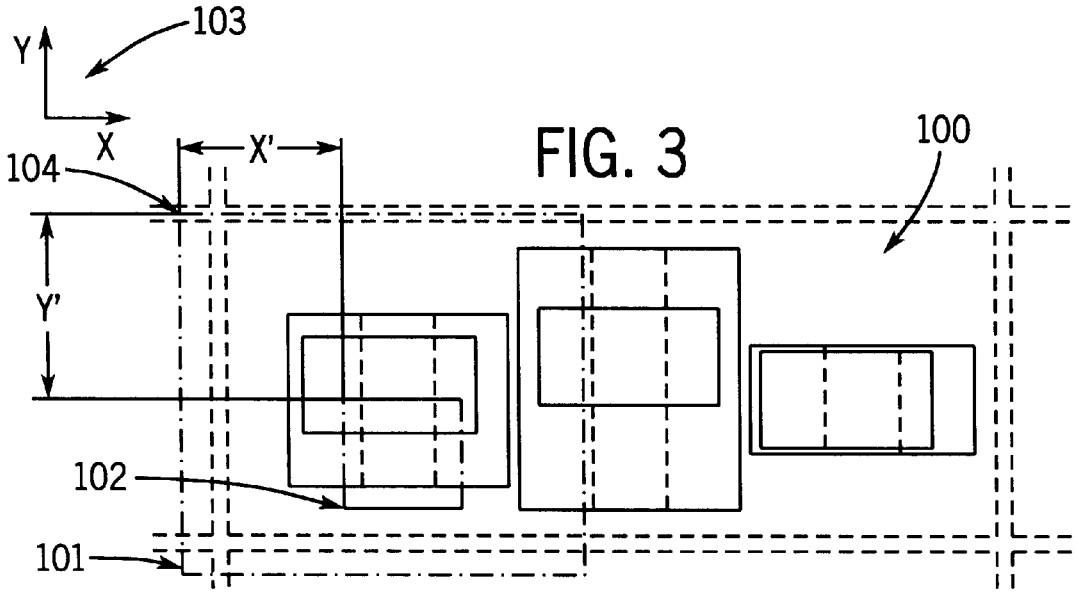
FIG. 3 presents a method of defining the image area.

The utilization of the dimensions of a known product or the automatic accuracy functions of some machine vision systems, when the focusing distance of the objective is known, e.g. Cognex Auto-Focus-function, enables also the damp of the load swing without a numeric positioning in the hoisting device, or a laser light source according to the previous example. The height data h can consequently be calculated by the program. When from the first full resolution video image area is "cut" a e.g. 64×64 pixel image area, this can be positioned from the next or the following pictures at a time delay of approx. 30–50 ms per picture to be reviewed (FIG. 3, 4). This results in the situation where the transition of the cut image area in each chosen new video picture can be determined compared to the original or a comparable picture. When the position of the pixels in relation to each other is known, the direction and speed of the swing of the crane gripper in relation to the ground, the trolley and/or the bridge can be determined. The measuring can start any time and the information about the time slot between the shots of the pictures to be compared is thus based on practical tests. If e.g. some product or the real size of its feature in the image area is known, which is the case when transferring products of standard type and size to or from the store, no height measuring is required, because the pixels of the picture can be changed into a relative motion when the distance of the gripper in relation to the target area has been determined by means of the known product or feature. If a combination of a camera and a laser light source is used, a sample of the laser light reflection ambience is taken using the above described video picture cutting method, and the transition of this cut area is compared with successive and very close picture shots.

Figure 4:
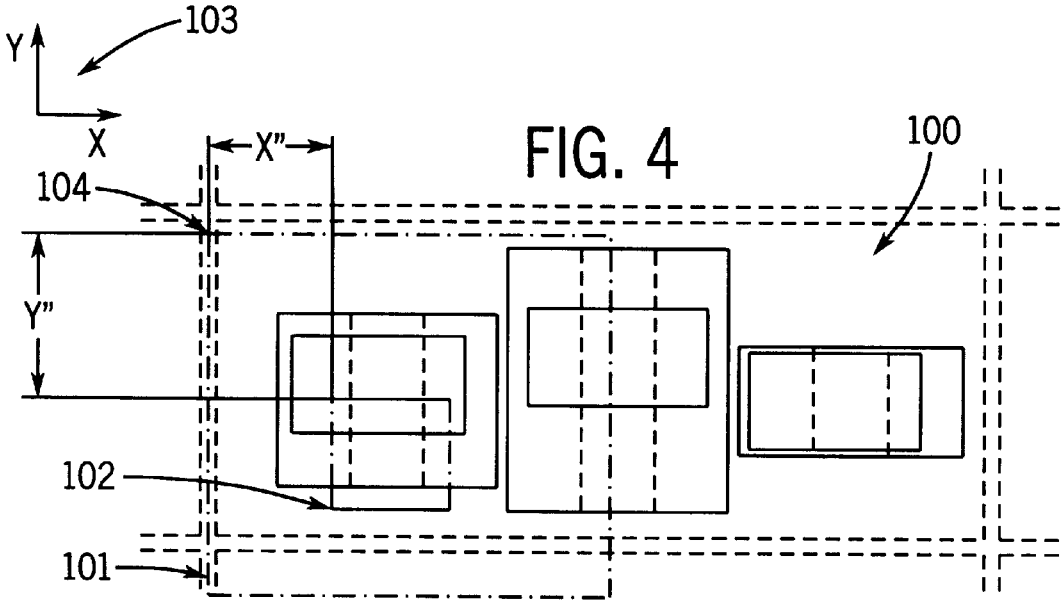
FIG. 4 presents a method of establishing the transition of the image area.

The information obtained from the camera picture is illustrated in FIGS. 3 and 4. In FIG. 3 the picture is taken from the area 100 below the camera with the camera 1 or 2 provided in the gripper 21, 22, thus showing part of the area below the camera. From the picture shown by the camera is determined the searched digital image area 102, which is part of 101, and which is saved in the computer digitizing card 10 memory. The searched area should be so located that the crane or the robot does not manage to drive out of the screen or that the picture angle to the area does not change too much, so that the lighting shadows could change essentially. The deviations e.g. X' and Y' of the searched image area are calculated from some image area point of the camera, e.g. from the vertical intersection point 104.

After a while, e.g. after 10–500 ms, a new picture 101 is taken with the same camera 1 or 2 as the previous picture. The digital image area 102 saved in the memory based on the crane or robot motion has moved in relation to the camera 1 or 2. The searched field 102 can be searched by the computer digitalizing card from the whole display or only from part of the camera display. When the machine vision system has searched all possible digital image area data from the defined searched area, the system informs the compatibility quality for each new target found of the picture field 101 at the digital image area 102 of the original picture. As the searched field 102 has to be individual and sufficiently large, there are not in practice two or more alternatives. If the system informs several fields to be suitable as the searched area, the qualitatively most suitable area is chosen. When found, the location of the area in the camera image area 101 can be calculated, thus providing X" and Y". If the relative transition of X" and Y" compared to the X' and Y'-measurements of the previous picture exceeds the defined limit and there are several such found fields, the qualitatively next one is chosen, etc. Finally, if the results are not reasonable, the positioning of the gripper swing is started all over (FIG. 3).

As the distance to the object is known either by the crane or robot digital positioning system or the known laser beam 32 mounted in inclined angle in the immediate vicinity of the camera, the motion direction, speed and acceleration of the cameras 1, 2 and thus that of the gripper can be determined by the relative motion distance differences of X' and X" and Y' and Y" calculating from the pixels.

Figure 5A:
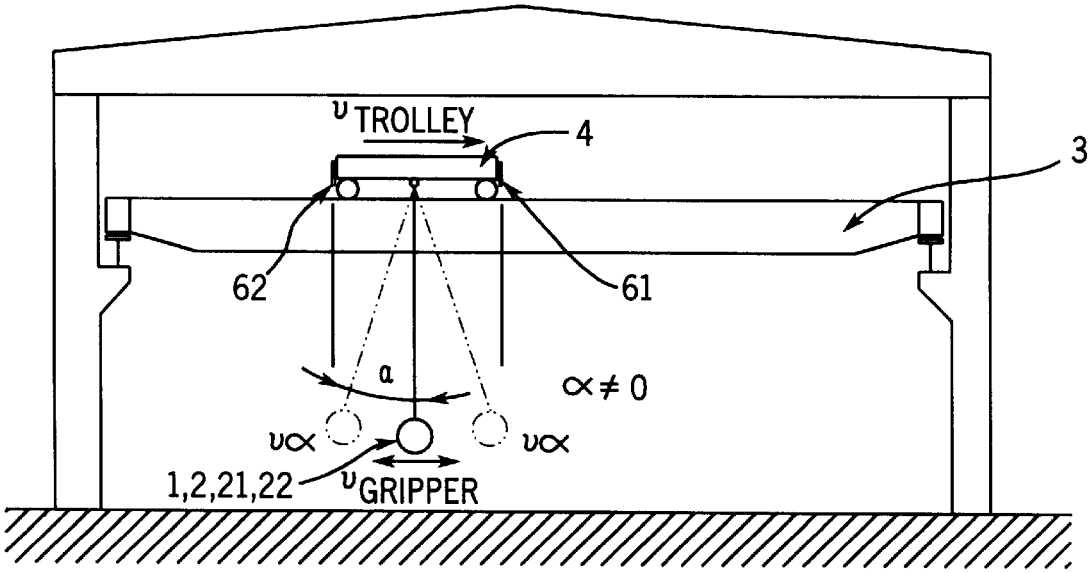
FIG. 5A and 5B show the swing motion of the load in relation to the trolley.
Figure 5B:
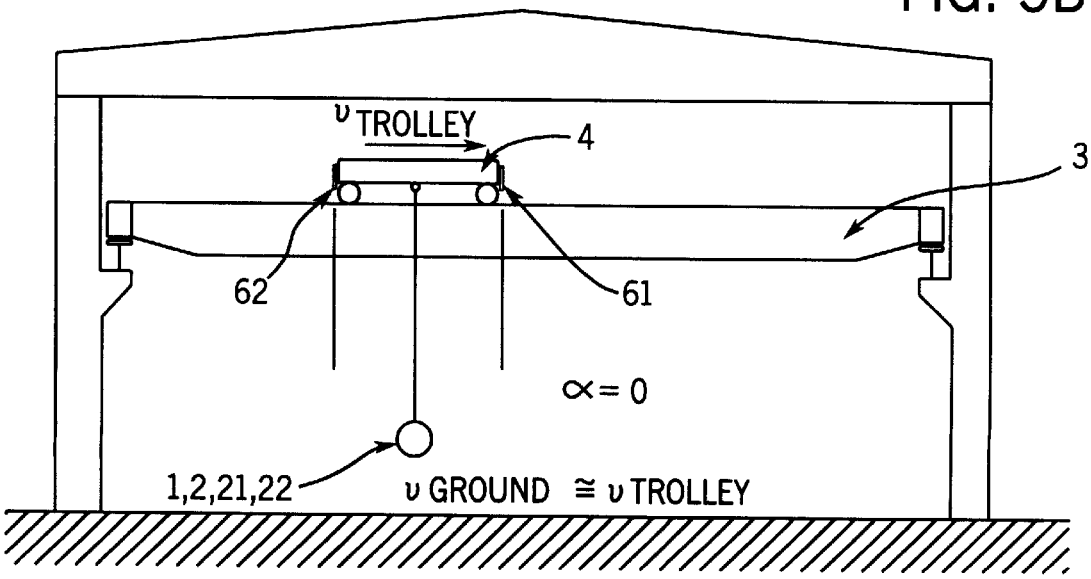

The searched digital image area data 102 must not contain light reflection of the laser light source 32 attached to the gripper 21, 22 (or it should come outside the field), because this high intensity light moves in relation to the searched image area 102 along with the cameras 1 and 2 and impairs the success of the search. If the crane is provided with a numeric positioning system, the motion speed of the gripper 21, 22 in relation to the crane or the robot can be determined and a real time correction of the gripper swing can be made by adjusting the speed of the crane or the robot. When the crane or the robot is operated at higher speed, the relative motion of the gripper is damped in relation to the motion speeds of the supporting structures of the crane or the robot, e.g. the bridge during measurement, and at low operating speed in relation to the ground and the actual target area. Especially, if the crane or the robot has not a numeric positioning system, the relative motion speed difference between the bridge and/or the trolley and the gripper as well as the swing angle of the gripper can be determined in relation to a fixed laser light or laser lights 61, 62 reflected during the picture shots on the same image area 100 from the trolley above (see. FIGS. 5A and 5B). The above mentioned measures X', Y', X" and Y" are thus calculated from this laser light reflection. The measuring result obtained is directly the relative motion speed of the gripper in relation to the corresponding motion directions of the crane. Because the load swings when the trolley or the other load carrying structure moves, the swing speed of the load can be equal to the speed of the trolley in both upper dead points (maximum swing angle $\alpha$). When the load is steadily in its place the above described positions can be separated from each other e.g. by a laser light 61, 62 reflected down from the trolley 4 observed by the identifiers 1 and 2, and the data obtained is converted into the load swing angle data. The swing angle of the load can be accurately determined in relation to the upper load-bearing structures even at small angle amplitudes. The laser light source is placed in the trolley 4 as shown in FIGS. 5A and 5B. The swing angle $\alpha$ is in the upper picture unequal to zero and in the lower picture 5 it is zero. In both pictures in FIG. 5B the driving speed of the trolley is $V_{trolley}$ in relation to the ground. The speed of the gripper swing motion is $V_{gripper}$, which in the upper picture varies between $V\alpha$ and zero. The relative speed of the gripper is in FIG. 5 presented by $V_{ground}$.

The digital image area data search can in some cases be facilitated by defining fixed identifiable signs or lines for the bottom area.

In the absence of a numeric positioning system in the crane, the cameras according to the invention offer a better positioning also at manual operation than e.g. is obtained with i.a. harmonic damping of the swing systems based on the mathematical pendulum formula ($T_0=2\sqrt{(1/g)}$, in which $T_0$=swing time (s), 1=hoist cable length (m) , g=9.807 m/s$^2$). In manually operated cranes the swing damping methods based on mathematical formulas and default values are generally characterized by their over or under positioning when driven manually to a predetermined point. The invention lacks this feature, as when the driver gives a stop command the swing is already in relation to the actual target area and the stop point is in the small image area 101 filmed by the cameras 1 and 2. The cameras 1 and 2 and thus also the gripper 21, 22 can be positioned by teaching the control system or by the data obtained during empirical research. The crane driver can by means of the machine vision system teach a crane lacking a numeric positioning the normal crane stop speeds and the requested deceleration distances. When the deceleration distance has been learned, the machine vision system provides for a repetition of the deceleration taught by the operator from the stop command to the point at a certain distance, and simultaneously performs the absorption of the load swing also with changing load masses.

The motion speeds and the directions can be specified both in the bridge and trolley direction. The slewing angle of the turning gripper can also be determined in relation to a chosen object.

The load absorption device of a container crane can also identify the set of numbers in the container end in order to secure the container content and loading address in the ship's hold. The automation increases the safety as the position of the containers in the ship are pre-determined for the stability of the ship. The same loading information can be utilized in the unloading harbor with a similar equipment directly into the computer system of the receiving harbor, which makes the material handling more effective both in the dispatching and the receiving harbor. Faults between the crane's or the robot's own internal coordinates and other coordinates can be corrected. The processor compares with the program the picture data received via the camera with previously recorded values.

The gripper is directed by the camera to a previously known product by means of teaching, parametrization, characteristic features of the target or based on data provided by the CAD-image. An active positioning of a moving machine part is created in relation to a known or expected target area and the positioning data of the moving machine part are coded with this result, simultaneously compensating bending and twisting in the load carrying structures caused by different loading situations.

Figure 6:
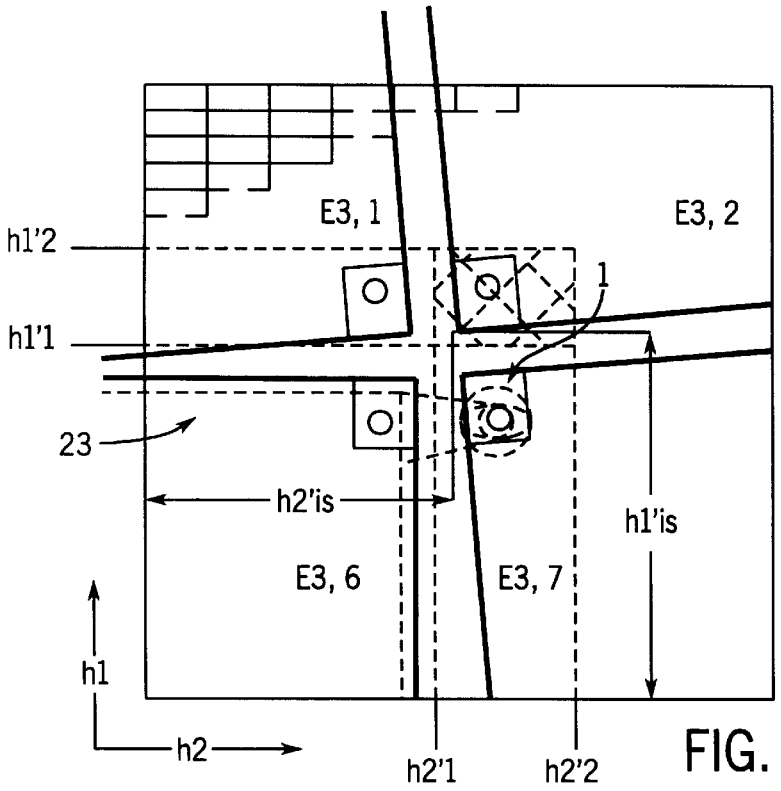
FIG. 6 shows a picture of the camera reviewing area.

When teaching the gripper, areas of the camera view angle can be indicated from which the searched features of the product are to be found and save these in the memory, as shown in FIG. 6. The camera image area consists of parts. As can be seen from FIG. 6, the image area inspected can be restricted to a certain area and in this case to the area restricted by h1'1, h1'2 and h2'1, h2'2. In FIG. 6 the container E3,6 is placed in relation to the containers E3,1 and E3,2 thus utilizing the data about E3,2 in this area when placing the container.

When products are transferred based on the typesetting figure in the memory and the possible change made in the image of the previously filmed area, the area in which to find the searched target is approximately known. As this is the case, only part of the camera picture can be reviewed. Each product has its own defined location point (deviation) in relation to the reference point. Based on this the crane is driven to the desired location according to predetermined location points. The cameras are directed to review the selected area defined in the deviation record of the product to be transferred and the known target from a limited image area defined in the deviation record to inform the actual location site of the product in relation to the location sites of known products or other predetermined target. When the camera has found the predetermined target, e.g. the angle of a previously transferred product, the crane control system positions the transferred product in relation to the found target.

The camera produces digital information which the computer program application utilizes in the gripper positioning. The camera comprises a camera and an application specific optic. Outdoors the camera is placed in a case, in which the window square in front of the camera lens is rotating preventing optic disturbances in the camera and also protecting the camera lens from weather impacts. The case can be provided with a heating device. The camera can be a black-and-white or a color camera. The resolution of the camera can vary starting from 128×128 pixels up to 1280×1024 pixels. As the final identification of the object is made from close and the object to be identified is generally big, the amount of pixels can also be smaller. In situations where smaller text or bar code is to be identified, a bigger pixel amount is required. In such cases it might be economical to implement the gripper positioning and the text or the bar code identification by parallel systems.

The objects to be identified can be classified in a small amount of classes according to some property (less than 10 classes) e.g. according to color. The colors are e.g. sorted in 256 different levels, the color pictures can be divided according to the main colors in 3×256 different levels.

After the classification the image is pre-processed into a more preferable form by digital image processing. After the pre-processing the objects and their parts are to be segmented from their background. There are two different methods of segmentation: area-based and edge identification. In the area-based method the image is divided according to colors into homogenous fields. In the edge identification, steep color change points are searched in the image, i.e. area edges. The safety of the crane can also be improved by the system during the transfer motions prior to the actual charge or discharge area. When the line of sight distance of the camera optic is adjusted to a distance which is twice to the crane stopping distance added with the computer overall response time, the grippers can be driven when there is no sharp line, curve, etc. in the field of view, but the image is blurred. When one for the data system sudden, unexpected sharp uniform junction appears in the image, the gripper motion is stopped.

The filming is intended to provide besides characteristics of the areas also their mutual relations. There is a very accurate mathematical model for the identification of a known object. By concentrating to find from the picture material junctions (steep color changing points) and comparing it to the model, an exact information about the location of the object in relation to the camera is obtained as a function of distance.

The state data of the camera optic at the teaching moment, i.a. focal length, distance, light are recorded simultaneously. With the control data in the crane or robot memory as well as inquiries about the crane or robot real time state data, the camera optic can be adjusted according to the location information in the camera memory so that identification of the object is facilitated and functions reliably.

Figure 8:
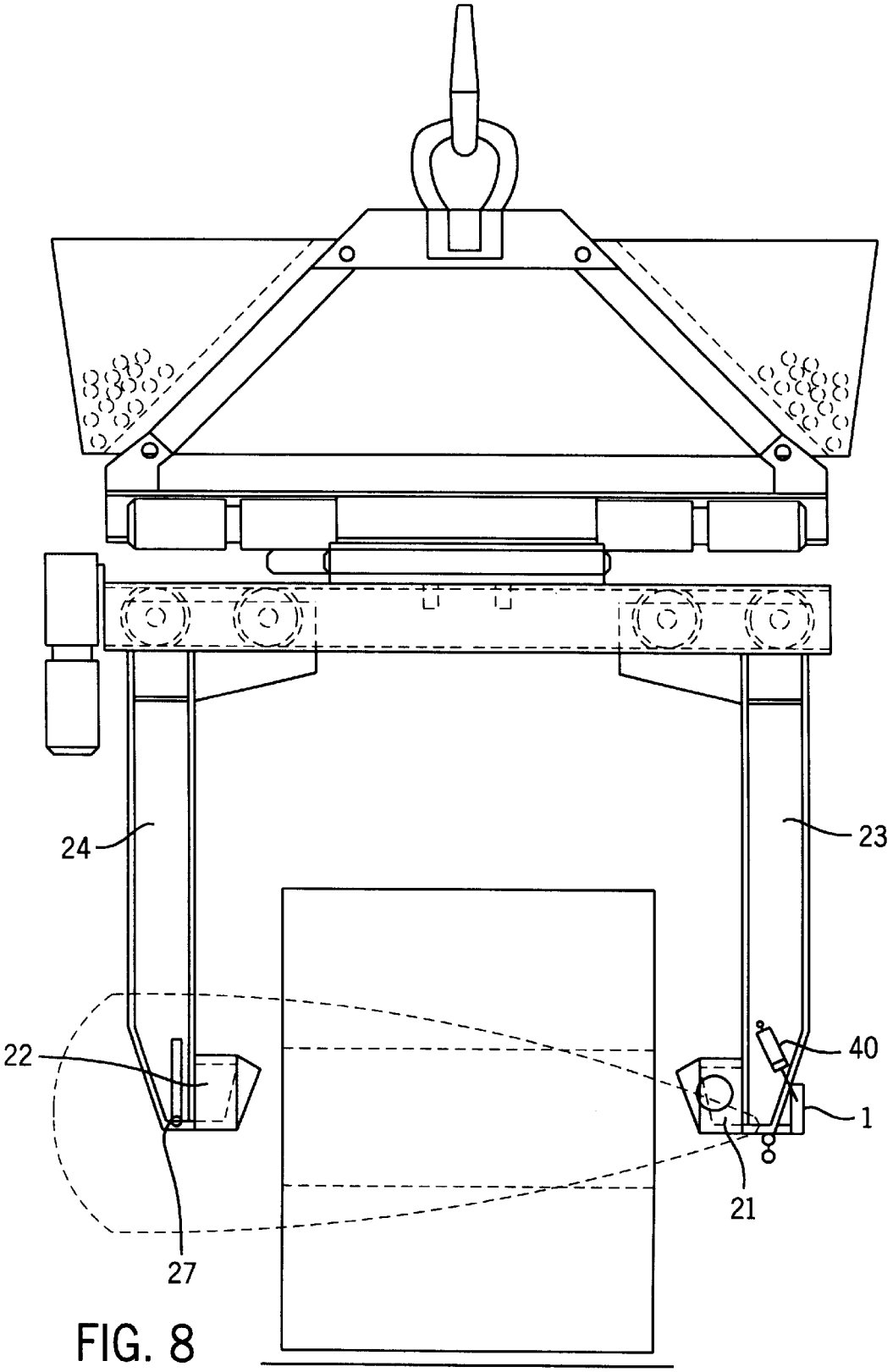
FIG. 8 presents one form of embodiment of the gripper and the cameras.

FIG. 8 presents a crane gripper intended to convey steel reels with the grippers 21, 22 provided in one end of the crane beams 23, 24. The cameras 1, 2 are placed in the crane beams 23, 24 close to the grippers, which cameras are turnable with a cylinder/piston 40 solution. One end of the cylinder or piston driver is supported in the crane beams 23, 24, and the other end of the cylinder is supported in the camera 1, 2. The deflection angle of the camera can normally be selected between 0–90 degrees, i.e. between the horizontal or vertical plane. In horizontal plane the cameras are directed against each other, and in vertical plane straight downwards. When the gripper crane beams are to grip the steel reel 25, they are moved against each other and inside the reel, whereafter the reel can be lifted.

Figure 9:
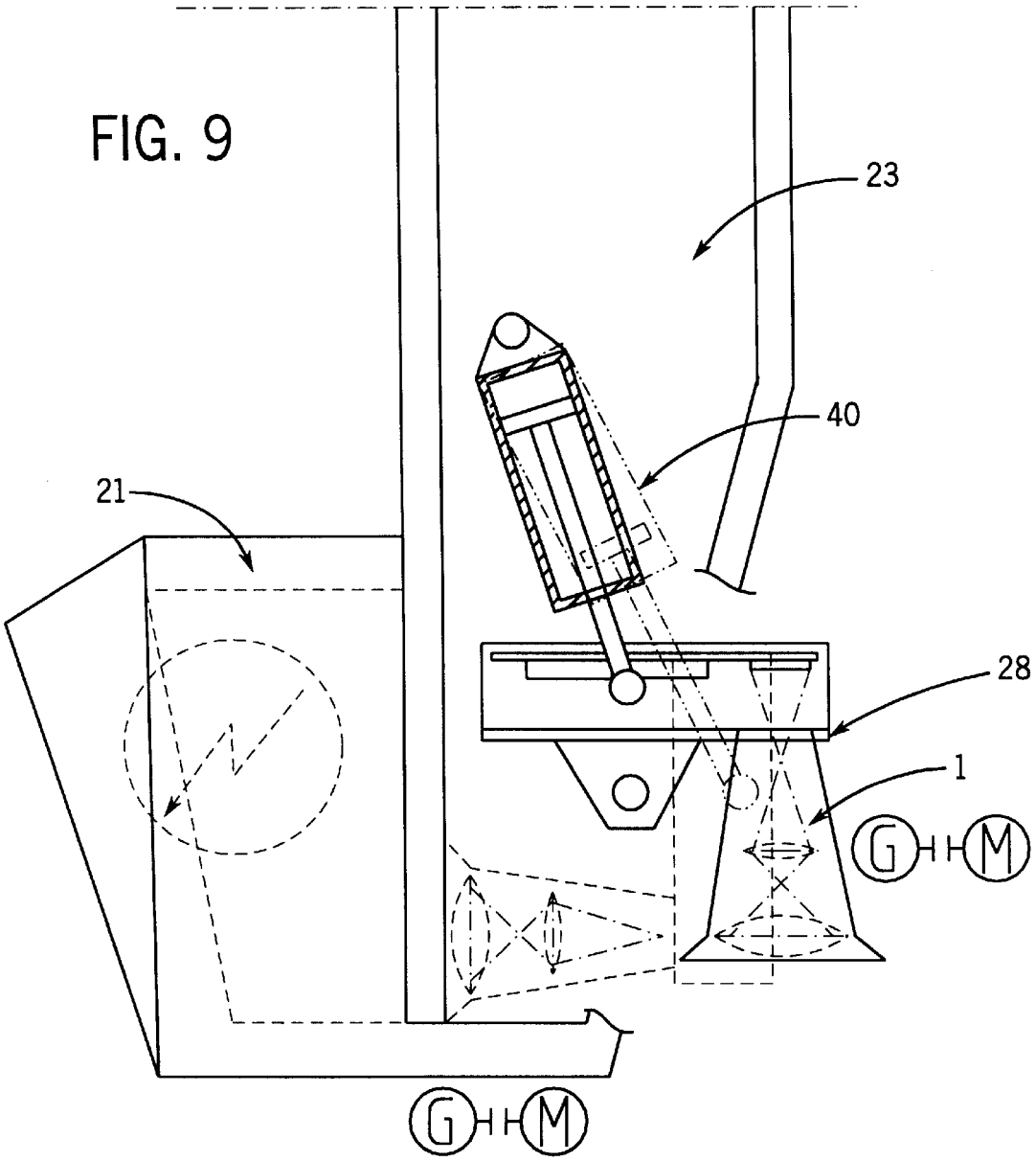
FIG. 9 shows an enlargement of the gripper according to FIG. 8.

FIG. 9 presents a closer picture of a gripper attached to the crane beam, and of the camera and the camera turning gear. Although the picture shows a piston/cylinder turning gear, also others can be used. In FIG. 9 the camera 1 is shown in first position as an unbroken line and in second position as a broken line, as also the cylinder/piston unit, correspondingly. The bottom area is inspected with the downward directed camera when the goods are to be lowered. When the goods are gripped, the cameras are turned towards each other. The turning gear comprises a piston/cylinder unit, one end of which is attached turnably to the crane beam and the other end turnably to the pivot plate 28, to which the camera 1 is attached. The pivot plate 28 is placed to turn in relation to the crane beam and the gripper.

Figure 10:
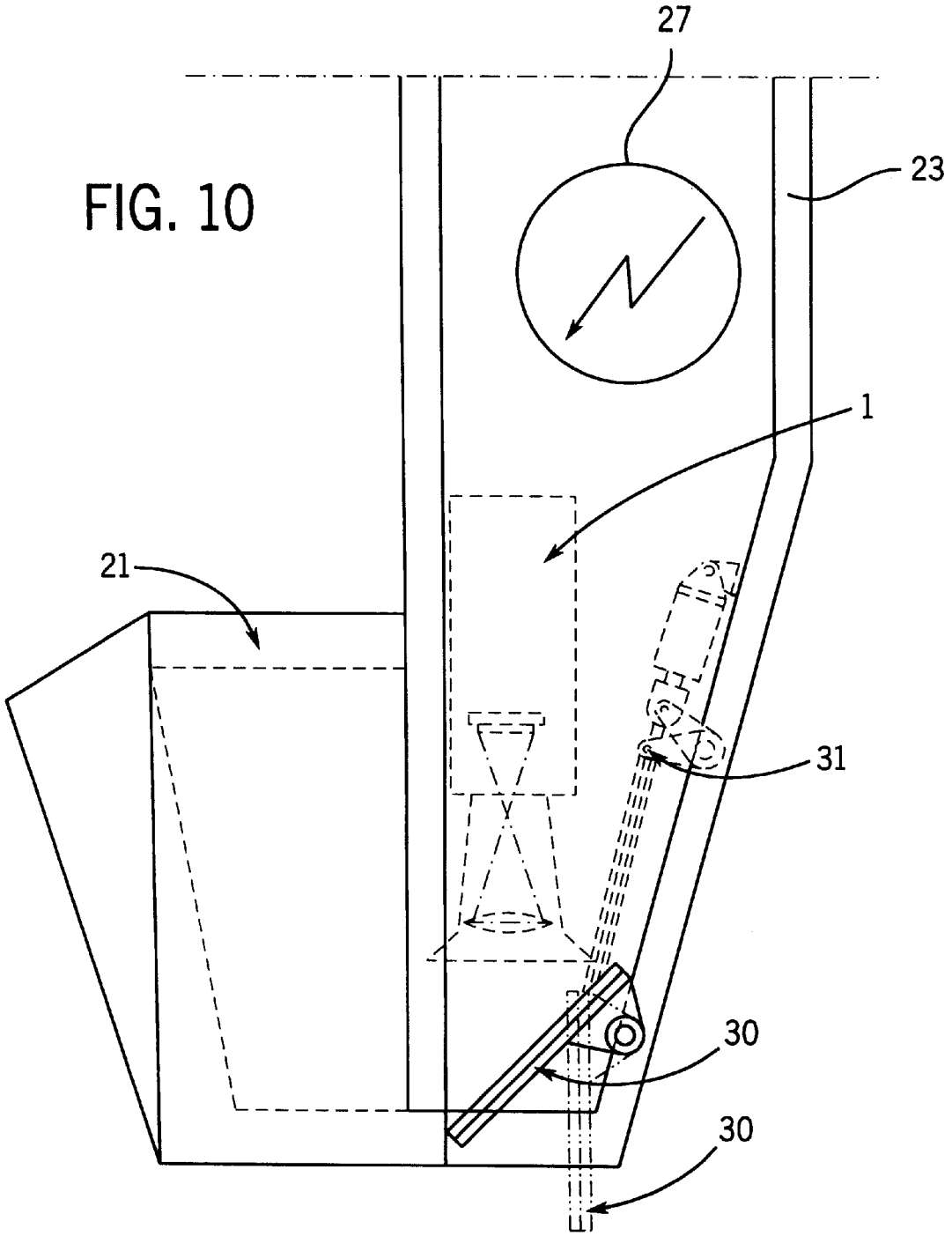
FIG. 10 presents the turning equipment of the reflecting surface.

FIG. 10 presents another form of embodiment of the inspection of two different image areas with the same camera. The camera 1, 2 is fixed to the crane beam in the vicinity of the gripper. In front of the camera 1, 2 image area can be placed a reflecting surface 30, i.e. a prism or a mirror, which in oblique position gives an image of the gripper, i.e. of the horizontal plane. When the mirror 30 is turned by the turning gear 31 in vertical position, the camera 1, 2 films its bottom area directly without the mirror 30. The picture of two areas can thus be reviewed with the same camera. The reflecting surface can be provided with additional properties, such as heating, etc.

As the planned system comprises alternatively two cameras located in relation to each other in known sites, the object can be approached by the triangulation principle. The objective is to identify by each camera points corresponding to each other located at different sites. Although the picture material is 2-dimensional, this two camera stereo vision system provides also the location of the object, as the size, width or diameter of the object are already known.

The identifiers can be placed in the gripper 21, 22, having an opening in the middle, to see through the opening of the other gripper 21, 22. One gripper can preferably be substituted by a light fixture 27, e.g. transversely in relation to the opening and with fluorescent lamps at the end of the opening, and when the light of the observed area visible from the camera picture matches the pre-determined one, the load can be gripped with the gripper according to the information obtained from the picture.

Figure 7:
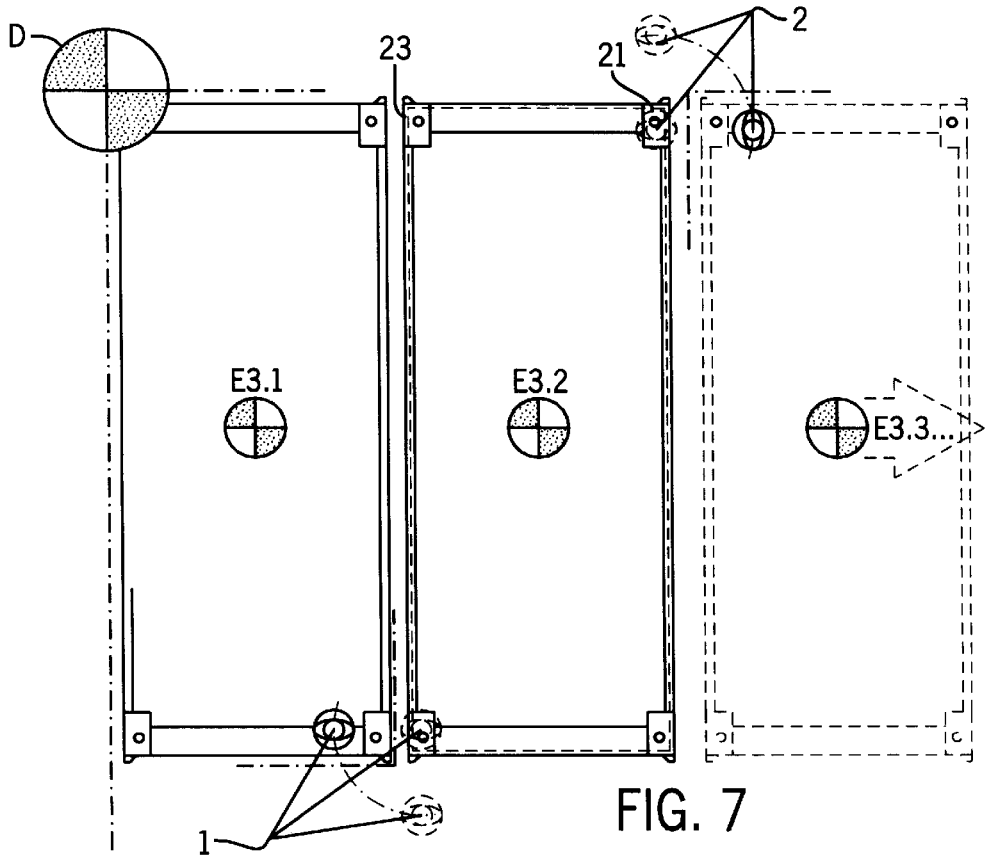
FIG. 7 shows different positions of the camera in relation to the load to be transferred.

FIG. 7 shows the placing of the containers in relation to each other. The mathematical addresses of the containers in FIG. 7 are E 3,1 E 3,2, etc. in relation to the D-point. In FIG. 7 the container has been moved to site E 3,1 adjacent to which is placed the next container in site E 3,2. The cameras 1, 2 attached to the grippers can be mounted in three different positions. In the first position—the unbroken line—the camera is outside the long side of the container (E 3,2). The position of the camera can be changed to e.g. outside the short side (pile edge on the long side) or to above the container gripper (container fetch with empty gripper). The latter positions of the cameras are presented by broken lines. Stepless turning gears can e.g. be used if other intermediate positions are required. The conventional cylinder gearing clearances in the camera attachment have been eliminated by coil springs acting in the opposite direction. The cameras can be furnished with light fixture(s) to maintain the light conditions essentially constant when taking the different pictures.

Figure 11:
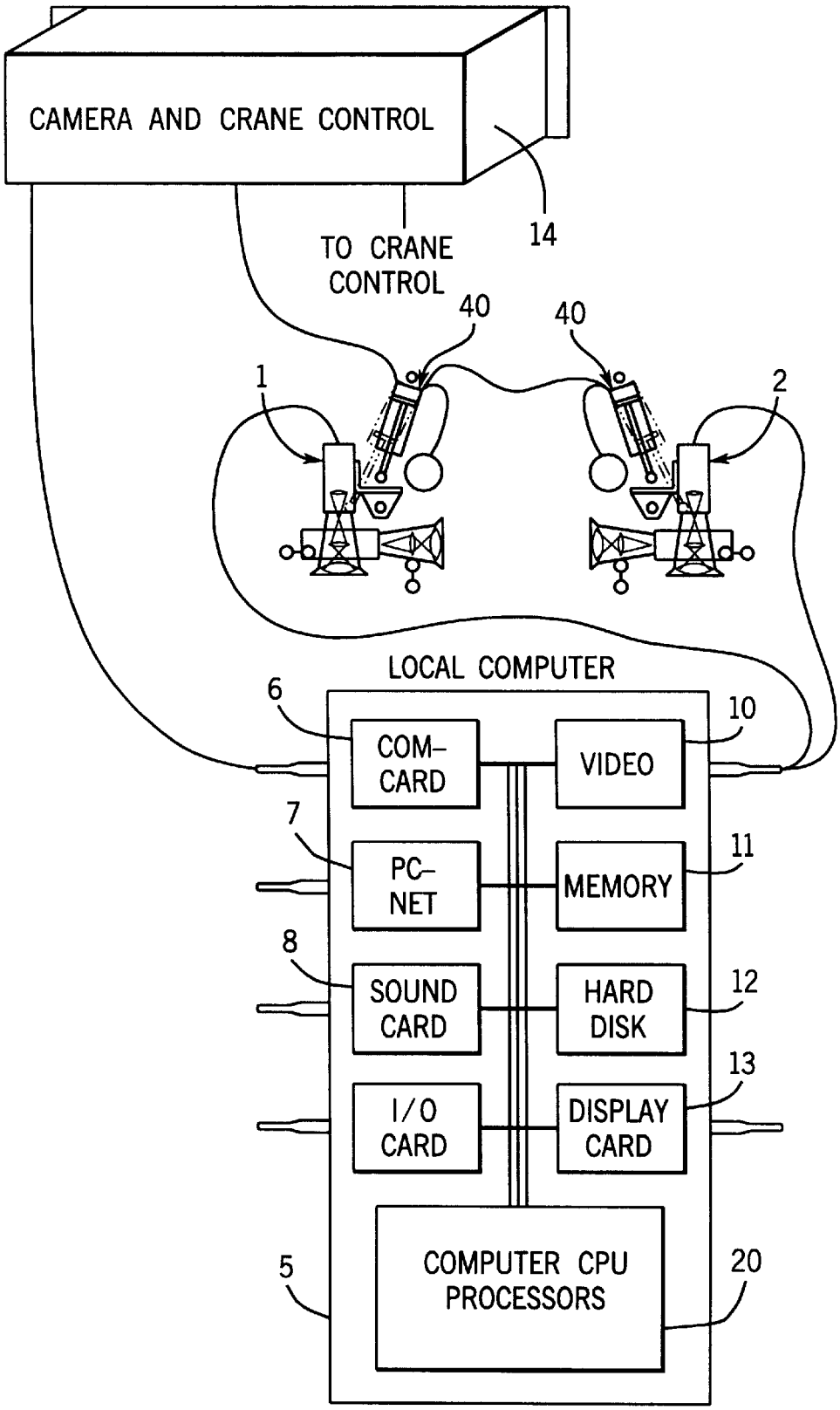
FIG. 11 presents a basic picture of the data management system.
Figure 12A:
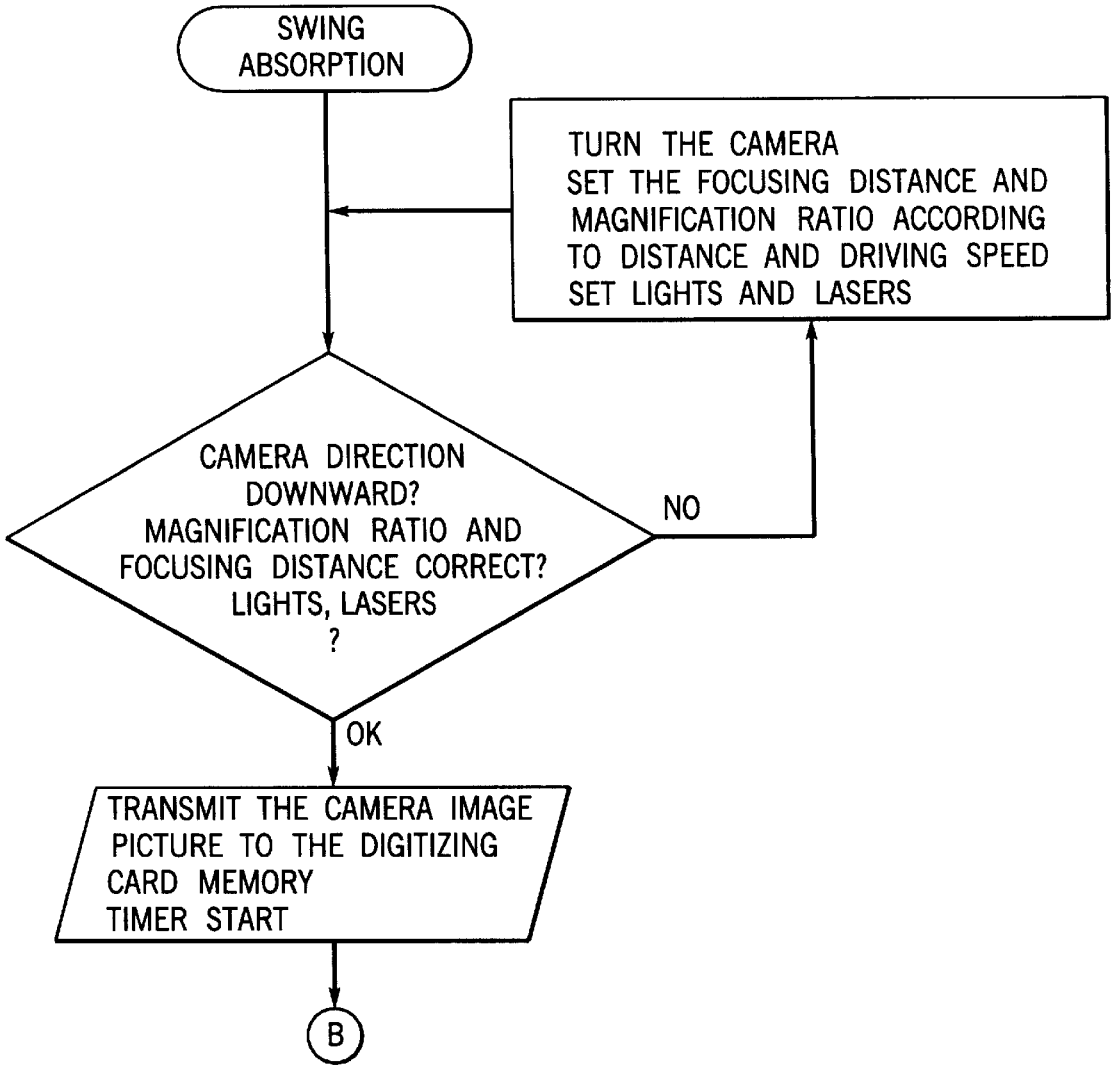
FIGS. 12A through 12E presents a flow diagram of the swing damping from its establishment to the crane or robot control.
Figures 12B, 12C:
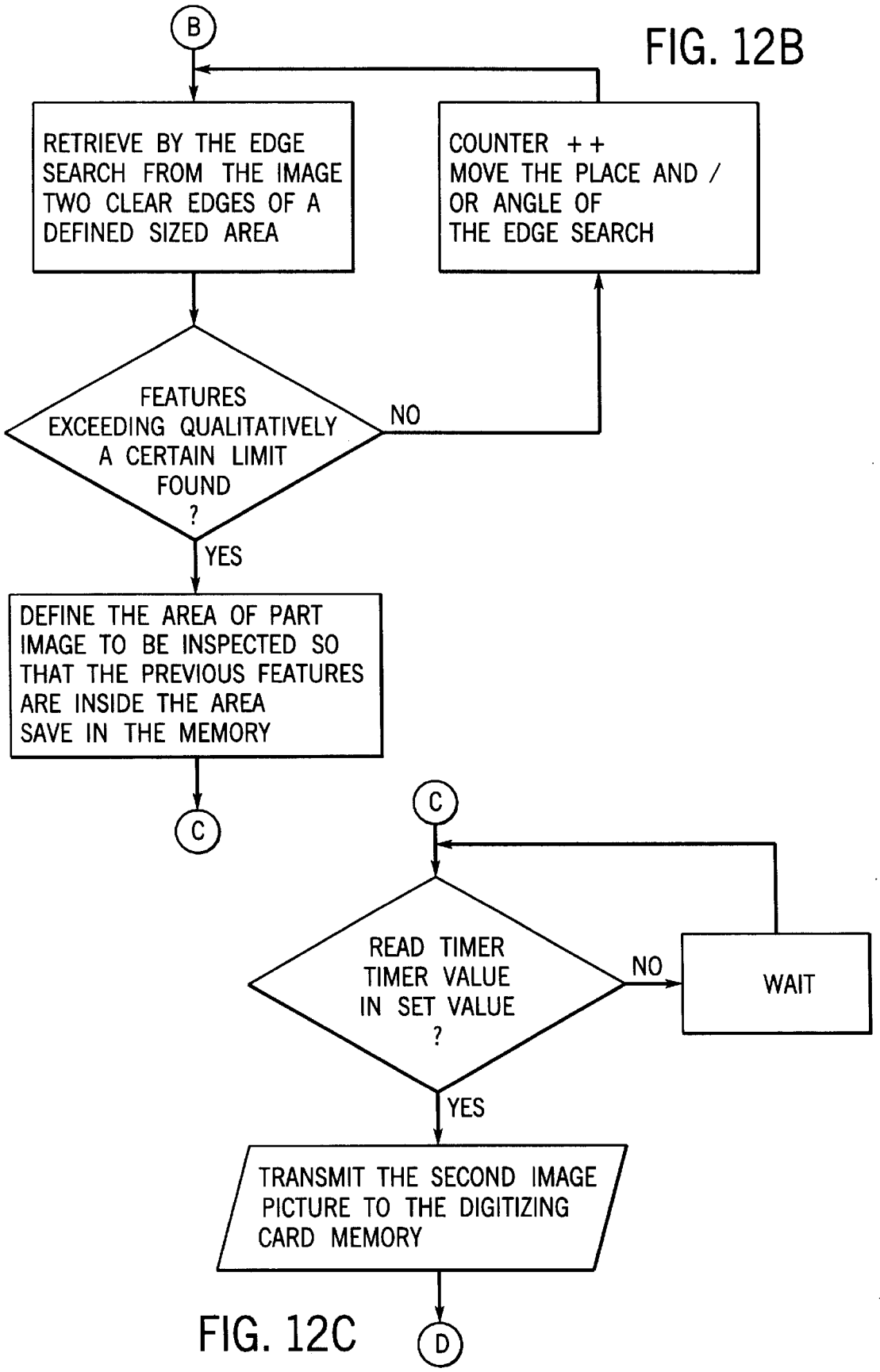
Figure 12D:
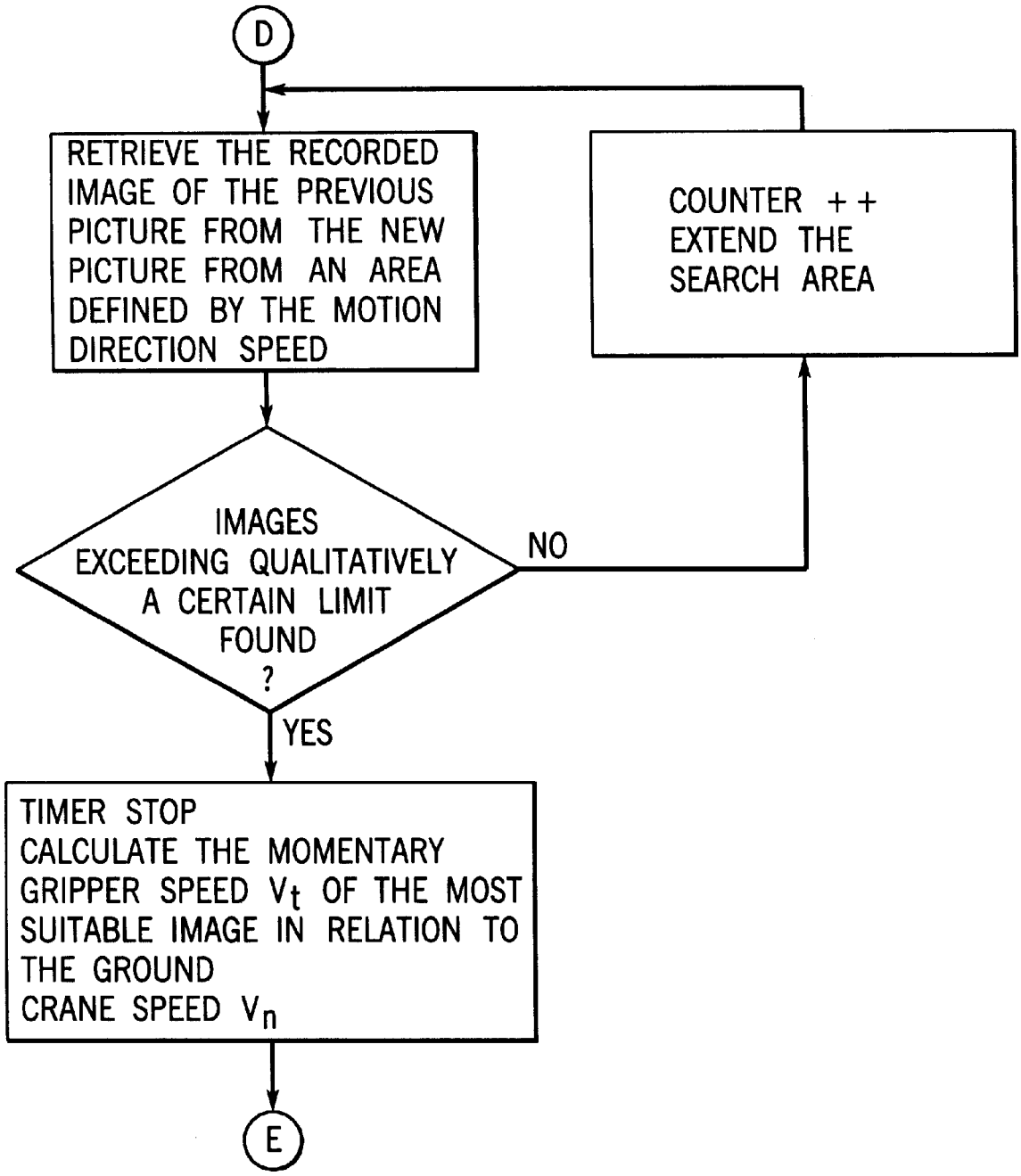
Figure 12E:
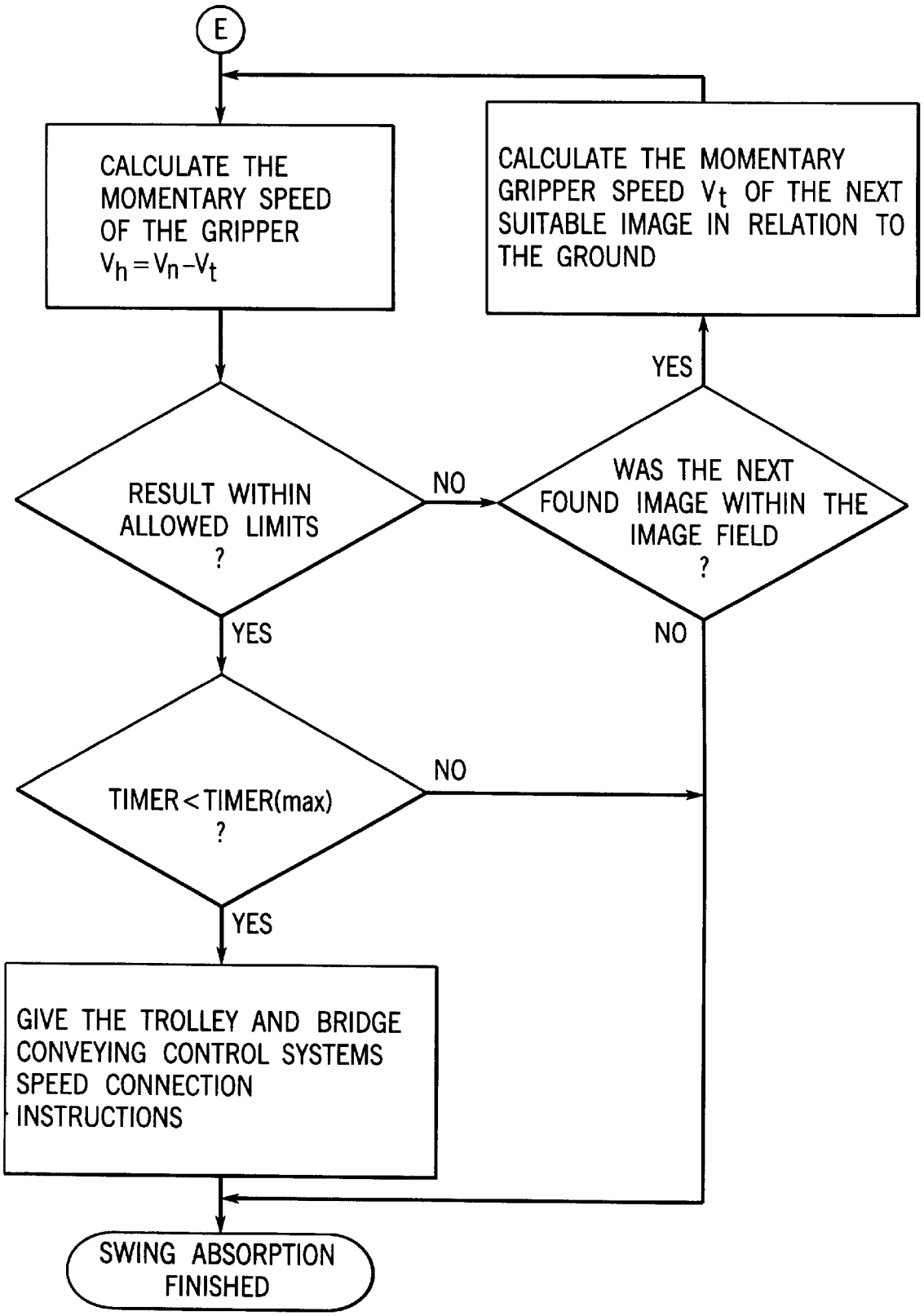

FIG. 11 presents an example of a crane and camera system. Each camera is attached pivotably to the crane gripper or its vicinity. The system comprises two cameras 1, 2 which are pivotable with the pivoting elements 40. The control and adjustment of the cameras and the turning elements are implemented according to the instructions of the local computer 5 through the crane logic controller. The image signal produced by the cameras is transmitted straight to the computer video cards. The computer 5 has a central processing unit 20, to which data transmission bus has been connected for the data transmission i.a. a communication card 6, a computer net card 7, a sound card 8, a video card 10, a memory unit 11, a hard disk 12 and a display card 13, which can communicate with each other. According to the data received from the central processing unit, the crane and the cameras can be controlled from the control unit 14, but on the other hand also based on data obtained from the camera. The computer can be provided i.a. with a CD-station, user interfaces (keyboard, microphone and loudspeakers, display), mass memory and modem. A program has been installed in the computer mass memory and the computer is connected to the control system. The computer operating system is a so called multi processing operating system having thus in use a multi media equipment. The control system controls the gripper or the crane in real time in a pre-programmed way (logic controller program). The control system comprises the logic control, the controls (forward, backward, right, left, slow, fast, etc), a digital positioning system and motor drives. The logic controller also attends to the real time control and adjustment operations of the camera optic turning elements.

The computer analyzes the video picture and tells the logic controller through a fast data transmission bus the deviation from the target point and in which direction. The possible operator can also be given sound messages, to easily show the I/O-data (the logic controller input/output-data) and to warn about risks, such as obstacles in the crane motion track, or error situations.

A fast data transmission bus is available between the computer and the logic controller. The computer has access to all data in the logic controller memory. If a fast data transmission is required, the transmission can be based on a short macro-protocol using e.g. current loop modems whereby the connection is straight and as fast as possible.

The loudspeakers connected to the computer enable the submitting of sound messages to the driver. The loudspeaker control is implemented through the computer multimedia card. It can either happen so that prior to the speech recording a call is made through the sound card or the recorded text is converted into speech by the program through the sound card, when there is an obstacle or due to some other pre-determined control. The gripper can be controlled with the microphone, when the sound is transformed into a signal comprehensible to the computer.

When a manually driven crane approaches the target area, the actual target area is reached with the machine vision system. The crane deceleration and acceleration should be of that size that the changing bulk (load) to be transferred does not essentially change the crane decelerations. If the bulk of the load would be decisive, the crane might just slide on the rail when stopped too quickly. During the acceleration the trolley reels would just roll around as the starting of the inertial mass requires overcuming its own inertia. The known and generally in design used acceleration and deceleration values for cranes are 0.1–0.7 $m/s^2$, preferably 0.3–0.5 $m/s_2$. The acceleration and deceleration of the robots are bigger, typically 1–4 $m/s^2$.

When the crane driver approaches the target area, he slows down the speed close to 0.6 m/s (3–6 m/min). The crane designer has calculated the deceleration within the limits of the above mentioned acceleration. The final acceleration is determined by the chosen driving gear, and therefore each crane has an application specific deceleration and acceleration. When the driver is an experienced crane driver, he drives at a low speed and takes his hand off the crane direction controller just at the right moment to reach the correct stop place. According to the crane's own deceleration, the crane continues still forward from the stop speed given by the driver along a relatively linear deceleration curve down to the stop, unless the driver makes new correction motions.

The crane or robot swing observation system and the use of the swing to control the speed are illustrated in a flow scheme in FIGS. 12A through 12D. In the damping of the swing is checked that the camera is directed downwards, the magnification ratio and the focusing distance are correct, the brightness is right and if laser is used, that it is correct. If everything is in order, the picture taken by the camera is transmitted to the digitizing card memory, the time when taking the picture is recorded. Two clear edges of a certain area are searched by the edge search. When the edges are found, the part of the picture to be inspected is determined, the edge features are thus included and saved in the memory. The next picture, which shooting moment is known, is transferred into the digitizing card memory. The recorded data of the previous picture is retrieved from the new picture from an area defined by the motion direction. When the viewed area is found, the momentary speed of the gripper in relation to ground is calculated from the pictures, which informs the speed of the crane. The momentary speed of the gripper is obtained, which is the speed of the crane minus the speed of the gripper. When the result is obtained, speed correction instructions are given to the trolley and the bridge speed control systems. Suitable additional pictures can be utilized in different stages.

A product marked with a label, e.g. bar code, provides directly information about the size and desired location site of the load, which can be considered as reference data.

It should be considered that the invention has above been presented only with reference to some examples. The invention is however not in any way to be considered restricted only to these solutions, the gripper e.g. is any gripping member or corresponding, but the invention includes the solutions a man skilled in the art can carry out within the scope of the enclosed claims.

What is claimed is:

1. A method for conveying a load between two location sites, at one of which sites the load is gripped for transfer, and at the other of which sites the load is discharged, said method comprising the steps of:

selecting a load to be gripped;

attaching at least one grip member to the load;

observing a first reference point adjacent the load, at least with identification means that is disposed on the grip member and operably connected to a control system to record information on the first reference point received from the identification means;

transferring the load toward the other location site, the other location site being defined by a second reference point adjacent the other location site that is identifiable by the identification means using information stored in the control system on the second reference point;

providing current information by observation with the identification means at specified intervals during conveyance of the load for use by the control system; and comparing the stored information on the second reference point to the current information provided by the identification means during conveyance of the load to identify the second reference point, and to control the conveying of the load to the other location site.

2. The method according to claim 1 characterized in that the observation is carried out using video images and that the location of the load is determined by the comparison of video images of one of the reference points taken at selected intervals.

3. A method according to claim 1 characterized in that the load can have its position at every point before, during and after transfer noted and recorded by the identification means.

4. A method according to claim 1 characterized in that the identification means comprises at least one video camera attached to the grip member and operably connected to the control system to provide image data on a reference point to the control system, the image data including prior and current image data contained in and used by the control system to control conveyance of the load, the image data having pixels, said method further comprising the steps of selecting defined pixels of the current image data in the control system, converting the current image data to current numerical data, transmitting the current numerical data to a computer, comparing the current numerical data to the numerical data obtained from prior image data, and determining transit distance data that is subsequently used by the control system to control conveyance of the load.

5. A method according to claim 4 characterized in that the prior image data is obtained by a method comprising the steps of taking pictures of a reference point with the video camera and converting the prior image data or pictures into prior numerical data, subsequently taking at least one picture of the reference point after a certain time interval, converting the current image data into current numerical data, and determining the transit distance data from a comparison of the prior and current numeric data to enable the control system to use the transit distance data to control the speed and direction of the conveyance of the load.

6. A method for conveying a load between two location sites, at one of which sites the load is gripped for transfer, and at the other of which sites the load is discharged, said method comprising the steps of:

selecting a load to be gripped;

attaching at least one grip member to the load;

observing a first reference point adjacent the load with at least one video camera that is disposed on the grip member and operably connected to a load control system to record information on the reference point received from the identification means;

transferring the load to the other location site, the other location site being defined by a second reference point adjacent the other location site as identified by the at least one video camera by taking a first picture of the other location site with the camera;

storing the picture into a computer memory and control system operably connected to the camera;

determining in the first picture a digital image area to be searched;

taking a second picture of the other location site with the camera; and comparing the digital image area of the second picture with the digital image area of the first picture to determine the relative transit distance from the position where the first picture was taken.

7. A method according to claim 6 characterized in that the position of the crane, the distance of the grip member from an object, and the speed of the trolley and/or the bridge are determined, and the speed of the trolley and the bridge is adjusted according to relative transit distance data.

8. A method according to claim 7 characterized in that the distance of the grip member from the object is determined by taking a picture of the object.

9. A method according to claim 4 characterized in that the object, from which the distance of the grip member is determined, comprises one of the load, a feature of the load, or a laser beam attached to the load.

10. A method according to claim 7 further characterized as determining the speed of the trolley and measuring the swing angle of the trolley or bridge using the camera and; adjusting the speed of the trolley and/or bridge.

11. A method according to claim 7 further characterized as identifying the load while attaching the grip member to the load.

12. A method according to claim 6 characterized in that, to determine the distance of an object from the camera, the camera is directed to a reference point placed at a known angle from the camera and detectable in the image taken by the camera.

13. A method according to claim 12 characterized in that the reference point is a laser beam applied to the load.

14. A method according to claim 12 characterized in that the reference point is a distinguishing shape on the load.

15. A method according to claim 7 characterized in that the camera is pivotally mounted to the grip member.

16. A method according to claim 15 characterized in that a mirror is pivotally mounted to the grip member adjacent the camera to selectively enable the camera to take pictures of objects reflected towards the camera by the mirror.

* * * * *